US011511930B2

(12) United States Patent
Strickler

(10) Patent No.: US 11,511,930 B2
(45) Date of Patent: Nov. 29, 2022

(54) METHODS OF ASSEMBLING A CIGARETTE PACKAGE

(71) Applicant: GRIP, LLC, Medford, OR (US)

(72) Inventor: Jesse O. Strickler, Medford, OR (US)

(73) Assignee: GRIP, LLC, Medford, OR (US)

( * ) Notice: Subject to any disclaimer, the term of this patent is extended or adjusted under 35 U.S.C. 154(b) by 841 days.

(21) Appl. No.: 16/433,443

(22) Filed: Jun. 6, 2019

(65) Prior Publication Data

US 2019/0283960 A1 Sep. 19, 2019

Related U.S. Application Data

(62) Division of application No. 15/897,906, filed on Feb. 15, 2018, now Pat. No. 10,358,282.

(51) Int. Cl.

| | |
|---|---|
| ***B65D 85/10*** | (2006.01) |
| ***B65B 19/12*** | (2006.01) |
| ***B65B 31/02*** | (2006.01) |
| ***B65D 53/04*** | (2006.01) |
| ***B65D 81/20*** | (2006.01) |
| ***B65D 41/04*** | (2006.01) |
| ***B65B 31/04*** | (2006.01) |

(52) U.S. Cl.

CPC ..... *B65D 85/10* (2013.01); *B65B 19/12* (2013.01); *B65B 31/025* (2013.01); *B65B 31/04* (2013.01); *B65D 41/045* (2013.01); *B65D 53/04* (2013.01); *B65D 81/2015* (2013.01); *B65D 81/2076* (2013.01)

(58) Field of Classification Search

None

See application file for complete search history.

(56) References Cited

U.S. PATENT DOCUMENTS

| | | | | |
|---|---|---|---|---|
| 1,373,577 A * | 4/1921 | Vallens | ..... | B65D 85/12 206/256 |
| 4,250,994 A | 2/1981 | Focke | | |
| 5,354,569 A | 10/1994 | Brown et al. | | |
| 5,945,147 A | 8/1999 | Borchard | | |

(Continued)

FOREIGN PATENT DOCUMENTS

CA 2235034 A1 * 10/1998 ..... A24F 15/00

OTHER PUBLICATIONS

Pre Rolled Joint Tubes. biohazardinc.com/joint-and-blunt-tubes/joint-tube-small.html. Last Accessed Jan. 29, 2018.

(Continued)

*Primary Examiner* — Hemant Desai
*Assistant Examiner* — Tanzim Imam
(74) *Attorney, Agent, or Firm* — SoCal IP Law Group LLP; Guy Cumberbatch

(57) ABSTRACT

A packaged assembly of a hermetically sealed container and cigarette, and method of forming the assembly. The container is hermetically sealed for airtight conditions for freshness, whereby an interior space is either filled with an inert gas or is evacuated down to a pressure close to 0 atm to remove substantially all air (oxygen) from within. The container may be clear glass to afford good visibility of the cigarette within an interior space thereof. However, a relatively large label may be affixed to the exterior of the container to occlude most of the light from reaching the cigarette.

20 Claims, 2 Drawing Sheets

(56) References Cited

U.S. PATENT DOCUMENTS

| | | | | |
|---|---|---|---|---|
| 7,124,883 | B1 * | 10/2006 | Thomas | B65D 85/10 206/256 |
| 8,863,947 | B2 * | 10/2014 | Sibley | B65D 81/266 206/265 |
| 9,096,336 | B2 | 8/2015 | Maas et al. | |
| 2004/0178088 | A1 * | 9/2004 | Zonker | B65D 85/10 206/242 |
| 2012/0111745 | A1 | 5/2012 | Stephenson | |
| 2019/0185242 | A1 * | 6/2019 | Brozell | B65D 51/145 |

OTHER PUBLICATIONS

Pre Rolls—Caviar Gold, https://caviargold.com/pre-rolls/ Last Accessed Jan. 29, 2018.

Tipton, Meghan. "5 Reasons Why Prerolled Joints Are a Gamechanger." Eaze Blog | Marijuana Education, News, and Culture, Dec. 29, 2017, www.eaze.com/blog/posts/5-reasons-prerolls. Last Accessed Jan. 29, 2018.

Noall, R.R. Here's Everything You Need To Know About Cavi Cones, Apr. 27, 2017, herb.co/marijuana/news/cavi-cones. Last Accessed Jan. 29, 2018.

MrMookster420. "Jays Joint Delivery." CC Forums, Dec. 20, 2004, http://forums.cannabisculture.com/forums/index.php?/topic/101363-jays-joint-delivery/. Last Accessed Jan. 29, 2018.

Glass Pre-Roll Tubes, www.kushbottles.com/products/Glass-Pre-Roll-Tubes. Last Accessed Jan. 29, 2018.

Stusser, Michael A. "The High End: The Best in Pre-Roll Branding." PRØHBTD, prohbtd.com/joints-spliffs-doobies-and-fatties-the-best-pre-roll-packaging. Last Accessed Jan. 29, 2018.

* cited by examiner 20
26
24
22
40
28
30
29
FRE
NE
ALL
IN A
BOT
GRO
IN
COLO
0.1 OZ

METHODS OF ASSEMBLING A CIGARETTE PACKAGE

RELATED APPLICATIONS

The present application is a divisional of co-pending U.S. patent application Ser. No. 15/897,906, filed Feb. 15, 2018, the contents of which are expressly incorporated herein.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to cigarette packaging.

Description of the Related Art

Cigarettes are formed of a thin, flat, burnable wrapper which encases an herbaceous substance. The herbaceous substance may be tobacco, *cannabis* or herbs such as cloves. Cigarettes are consumed by smoking, though some forms involve inhaling while others do not. Cigarettes may be produced manually, such as by the end user, or by a machine. Conventionally, a user deposits loose herbaceous combustible material in a line parallel to a long dimension of a cigarette paper, generally opposite to a gummed edge. By folding over and then rolling the ungummed edge around the line of combustible material, a cylindrical cigarette is formed which is held together by securing the gummed edge to the exterior of the outer layer of paper. Machines which perform the function are well known, including fully automated machines in use for many years to manufacture tobacco cigarettes, as well as more recently automatic, semi-automatic and manual machines available to roll *cannabis* joints, see http://weedshome.com/top-10-rolling-machines. Many vendors now offer so-called "pre-rolled" joints for those unable or unwilling to roll themselves. Such pre-rolled joints are often formed by filling a pre-formed conical cigarette paper ("cones") with loose leaf from the large diameter end and then sealing or twisting the end closed.

In general, freshness is highly desirable in a cigarette. Not only does oxygen eventually degrade the quality of the herbaceous substance, but exposure to light also affects aspects such as moisture content, color and taste. Consequently, there is a need for an improved way to store and ship cigarettes.

Throughout this description, elements appearing in figures are assigned three-digit reference designators, where the most significant digit is the FIG. number where the element is introduced and the two least significant digits are specific to the element. An element that is not described in conjunction with a FIG. may be presumed to have the same characteristics and function as a previously-described element having the same reference designator.

DETAILED DESCRIPTION

A packaged assembly of a hermetically sealed container and cigarette, and method of forming the assembly are disclosed. The container may be glass and hermetically sealed for airtight conditions. The hermetically sealed interior space within the container may be filled with an inert gas, or evacuated down to a pressure close to 0 atm to remove substantially all air from within. The container may be clear to afford good visibility of the cigarette within an interior space thereof. A relatively large label may be affixed to the exterior of the container to occlude most of the light from reaching the cigarette. The label may include product information, branding, designs, warnings, etc.

Figures 1A, 1B, 1C:
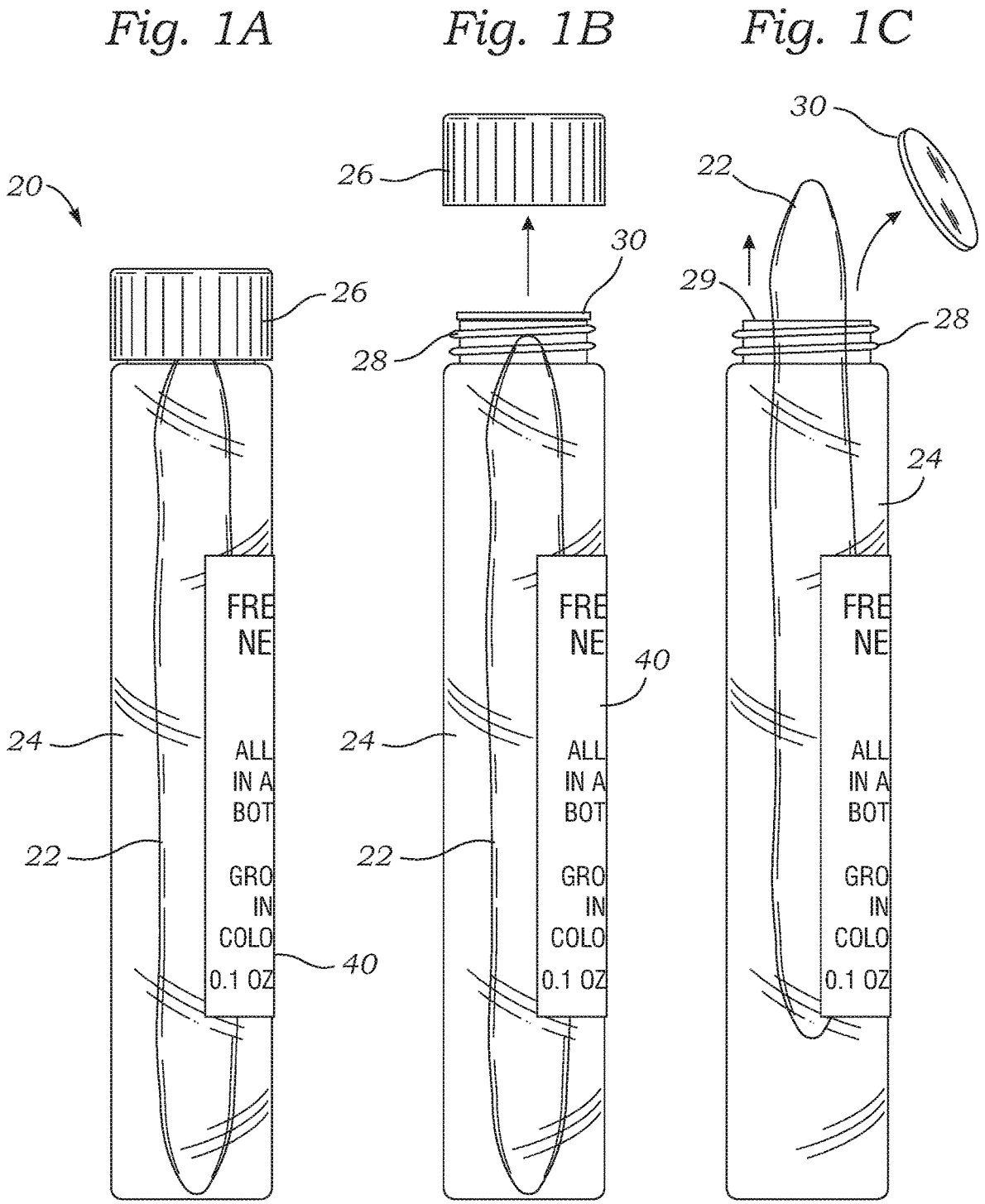
FIG. 1A is a side view of a packaged cigarette.
FIG. 1B is a side view of the packaged cigarette of FIG. 1 with an exterior cap removed.
FIG. 1C is a side view of the packaged cigarette of FIG. 1 with the exterior cap and an interior seal removed, and showing removal of the cigarette therefrom.

FIG. 1A is a side view of a package 20 for a cigarette 22. Providing the container 24 as a narrow cylinder enables packaging of one or more cigarettes therein, typically one or two. The package 20 comprises a rigid-sided container 24 which may be glass topped with an exterior cap 26. FIG. 1B is a side view of the package of FIG. 1 with the exterior cap 26 removed. The cap 26 may have internal threads (not shown) that mate with external threads 28 on an upper mouth 29 of the container 24.

A seal 30 is in contact around the open mouth 29 and sealing the interior space of the container from the surrounding atmosphere. The container 24 may be a narrow tube with a closed end opposite a circular open mouth 29 just beyond the external threads 28, and the seal 30 may be elastomeric and a circular solid disk. The seal 30 may be made of various elastomers such as silicone rubber, polyurethane, natural rubber, Polybutadiene, or the like. The seal 30 has a thickness which resists collapse and may be selected so as to remain relatively planar over the open mouth 29. FIG. 1C is a side view of the sealed package 20 with the exterior cap 26 and the interior seal 30 removed, showing removal of the cigarette 22 therefrom.

The seal 30 hermetically seals the interior space within the container 24 which permits the cigarette 22 to be stored in an oxygen-free environment to preserve freshness. An oxygen-free environment may be established by evacuating substantially all the oxygen within the container or by introducing a majority of inert gas within the container, which displaces the ambient air. Common inert gasses which may be used include nitrogen, argon, and helium. $CO_2$ may also be used which, though it has oxygen atoms, maintains freshness of cigarettes in a similar manner since the oxygen is not free but instead is covalently double bonded with the carbon atom in the $CO_2$ molecule.

Freshness of the cigarette in the package may be disclosed to the consumer in a number of ways. Removal of the seal 30 may cause a sudden pressure rise within the container resulting in an audible sound, such as a brief hiss or a pop. The audible sound alerts the consumer to the fact that the seal of the interior space was intact, evidencing maximum freshness. A strip of oxygen-sensitive paper or other material may be included within the container 24 which turns a different color in the presence of oxygen, such as when the seal 30 is disturbed. A pressure-sensitive indicator such as a small pouch or the like may be placed in the container 24 which becomes inflated when a vacuum is created in the container and deflates when the seal 30 is broken. A tamper-resistant indicator may be used, such as a heat shrink wrapper around the exterior cap 26 which must be destroyed before opening the container 24.

The cigarette 22 may be made of one or more of tobacco, dried leaves such as stinging nettle or jimson weed, marijuana and other forms of smokable *cannabis*, or herbs such cloves. The cigarette paper is typically made from thin and lightweight "rag fibers" (nonwood plant fibers) such as flax, hemp, sisal, rice straw, and esparto. The paper is available in rolls and rectangular sheets of vas g sizes, and has a narrow strip of glue along one long edge. Consequently, to be clear the term "cigarette" pertains to any and all products having loose leaf material within a cylindrical or conical combustible outer wrapper/paper, using *cannabis*, other herbs, tobacco, or mixtures thereof.

Figure 2:
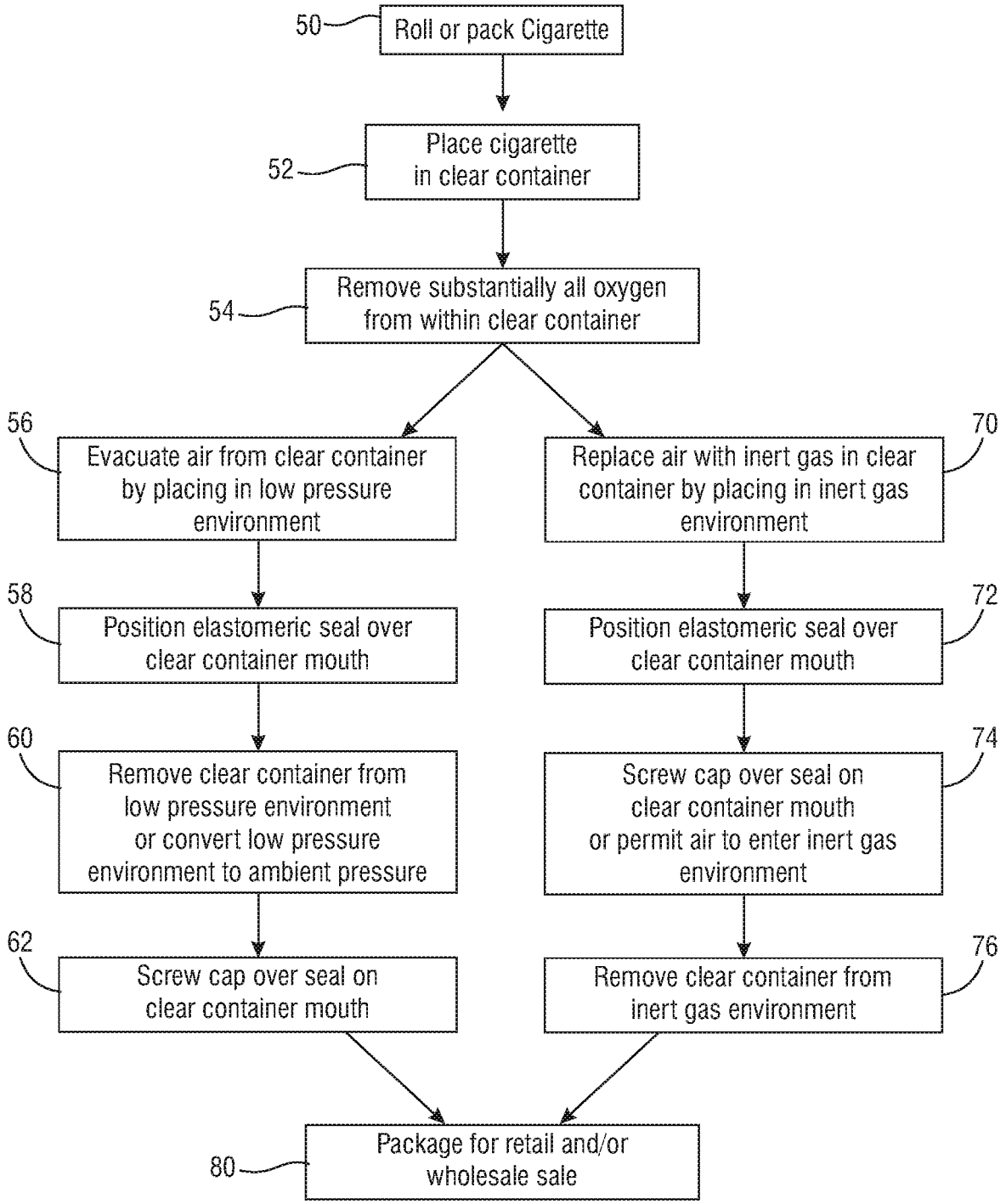
FIG. 2 is a flowchart showing a process of assembling a packaged cigarette.

FIG. 2 is a flowchart showing a process of assembling a packaged cigarette such as the sealed package 20. In initial step 50, a cigarette is formed by hand or with the use of a machine, either by rolling or filling a pre-rolled cone, e.g. Subsequently, in step 52, one or more cigarettes are placed within the clear rigid container (preferably clear glass). The next step 54 of removing substantially all of the oxygen from within the container may be performed in one of several ways, two of which are shown in diverging branches.

In a first method, step 56 commences by evacuating air from the glass container. This may be accomplished by placing the container in a larger enclosed space or chamber and pulling a vacuum so that the environment within the enclosed space experiences a reduction in pressure. The vacuum may be as near to 0 atm as possible to ensure substantially all of the oxygen has been removed.

Step 58 involves placing an elastomeric seal over the open mouth of the container while the container is still in the low pressure environment. Subsequently, in step 60, the assembler removes the container from the low pressure environment which creates a pressure differential between the inside and the outside of the container and consequently pulls the seal down over the open mouth. Alternatively, the evacuated chamber may simply be brought back up to ambient pressure with the container(s) still inside. The pressure differential pulls the elastomeric seal firmly down around the container mouth and the elastomeric material deforms to an extent to conform around and seal against the mouth. Finally, in step 62 an exterior cap is added over the container mouth which conceals and protects the elastomeric seal.

In a second method, step 70 involves removing substantially all of the oxygen from within the container by replacing air with a gas such as an inert gas, for example by placing the glass container in an inert gas environment/chamber. Alternatively, the free oxygen atoms may be removed by evacuation prior to filling the chamber with a gas. After a short period, all of the air has been replaced with the inert gas. Then, in step 72, a seal is placed over the open mouth of the container while the container is still in the inert gas environment. Step 74 includes adding an exterior cap over the container mouth which conceals and protects the elastomeric seal. Step 74 may be performed while the container remains in the inert gas environment, to avoid allowing any air (oxygen) to seep back into the container. If the chamber has previously been evacuated to a low or 0 atm pressure, reintroducing atmospheric conditions to the chamber prior to adding the cap will cause the seal to press against the container mouth, thus sealing the gas inside. Finally, the assembler removes the sealed and capped container from the inert gas environment in step 76.

Step 80 is common to either method of sealing the container without oxygen, and involves packaging the containers for retail and/or wholesale sale. If glass is used for the container, rigid and cushioned outer packaging may be used to prevent breakage.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A method of assembling a sealed cigarette package, comprising:

a) placing a cigarette within an interior space of a container, the container having rigid walls and an open mouth at one end and being closed at the other end, the walls including a transparent region, b) placing a hermetic seal in contact with the open mouth to form an assembly, c) locating the assembly within a vacuum chamber, d) while the assembly is in the chamber, evacuating the vacuum chamber of all free oxygen atoms so that a pressure of the vacuum chamber is below ambient pressure, e) while the assembly is in the evacuated chamber, introducing an inert gas into the chamber while maintaining the chamber at the pressure below ambient pressure, f) after adding the inert gas into the chamber, bringing the pressure of the chamber back up to ambient pressure such that a pressure differential between the interior space of the container and the chamber causes the hermetic seal to seal the mouth of the container and form a sealed assembly, g) removing the sealed assembly from the vacuum chamber, and h) securing a rigid cap over the mouth of the container.

2. The method of claim 1, wherein the gas is Nitrogen.

3. The method of claim 1, wherein the gas comprises one or more of Argon and Helium.

4. The method of claim 1, wherein the gas includes $CO_2$.

5. The method of claim 1, wherein the hermetic seal is formed of an elastomeric material in contact around the open mouth and the elastomeric material conforms around and seals against the mouth.

6. The method of claim 1, wherein the container is made of glass.

7. The method of claim 1, wherein the container is a narrow tube that has an interior space slightly larger than the cigarette.

8. The method of claim 1, wherein the entire container is transparent.

9. The method of claim 8, further comprising an opaque label attached to the container.

10. The method of claim 1, wherein a pressure within the container of the sealed assembly is 0 atm.

11. The method of claim 1, further including placing a strip of oxygen-sensitive material within the container configured to turn a particular color in the presence of oxygen.

12. The method of claim 1, further including a placing pressure-sensitive indicator within the container configured to inflate when the pressure in the container is below ambient pressure and deflate if the pressure in the container rises to ambient pressure.

13. The method of claim 12, wherein the pressure-sensitive indicator is a small pouch.

14. The method of claim 1, further including adding a tamper-resistant indicator around the rigid cap which must be destroyed before opening the container.

15. The method of claim 14, wherein the tamper-resistant indicator is a heat shrink wrapper.

16. The method of claim 1, wherein the cigarette is formed of paper rolled around a combustible material selected from the group consisting of stinging nettle, jimson weed, marijuana, and herbs.

17. The method of claim 16, wherein the paper is made of nonwood plant fibers selected from the group consisting of flax, hemp, sisal, rice straw, and esparto.

18. The method of claim 1, wherein the cigarette is formed of marijuana.

19. The method of claim 18, wherein the container is a narrow glass tube that has an interior space slightly larger than the cigarette.

20. The method of claim 19, further comprising an opaque label attached to the container.

* * * * *